US005777947A

United States Patent [19]

Ahuja

[11] Patent Number: 5,777,947

[45] Date of Patent: Jul. 7, 1998

[54] APPARATUSES AND METHODS FOR SOUND ABSORPTION USING HOLLOW BEADS LOOSELY CONTAINED IN AN ENCLOSURE

[75] Inventor: Krishan Kumar Ahuja, Atlanta, Ga.

[73] Assignee: Georgia Tech Research Corporation, Atlanta, Ga.

[21] Appl. No.: 412,516

[22] Filed: Mar. 27, 1995

[51] Int. Cl.[6] ..... F01N 1/24

[52] U.S. Cl. ..... 367/1; 367/191; 181/256; 60/322

[58] Field of Search ..... 367/1, 176, 191; 181/231, 175, 196, 198, 204, 227, 228, 252, 256, 258; 60/322, 323

[56] References Cited

U.S. PATENT DOCUMENTS

| | | | |
|---|---|---|---|
| 3,132,714 | 5/1964 | Gary, Jr. et al. | 181/33 |
| 3,819,009 | 6/1974 | Motsinger | 181/33 |
| 4,135,603 | 1/1979 | Dean, III et al. | 181/286 |
| 4,231,447 | 11/1980 | Chapman | 181/213 |
| 4,319,661 | 3/1982 | Proudfoot | 181/295 |
| 4,539,947 | 9/1985 | Sawada et al. | 123/52 |
| 4,546,733 | 10/1985 | Fukami et al. | 123/52 |
| 4,600,078 | 7/1986 | Wirt | 181/286 |
| 4,944,362 | 7/1990 | Motsinger et al. | 181/213 |
| 5,024,289 | 6/1991 | Merry | 181/231 |
| 5,189,266 | 2/1993 | Sasaki et al. | 181/227 |
| 5,210,383 | 5/1993 | Noxon | 181/290 |
| 5,419,127 | 5/1995 | Moore, III | 60/322 |

OTHER PUBLICATIONS

AeroSpheres, An attractive new alternative for the high-temperature, engineered materials market, Ceramic Fillers, Inc.

Thin-Wall Hollow Spheres From Slurries and Thermally Insulating Materials — Model & Measure, Ceramic Fillers, Inc.

*Primary Examiner*—Daniel T. Pihulic

*Attorney, Agent, or Firm*—Hopkins & Thomas

[57] ABSTRACT

A sound absorption device in accordance with this invention includes an enclosure loosely containing hollow beads. Preferably, the hollow beads have openings, and differ with respect to the volume of the hollow space defined by the walls of the beads, the wall thicknesses of the beads, the size of the openings of the beads and/or the number of openings on the beads. Through Helmholtz resonance, vorticity and tortuous path scattering, the beads damp sound waves over a broad range of frequencies. Preferably, the beads are formed from a material able to withstand relatively high temperatures, such as ceramic or nickel. The beads can thus be used to damp sound in applications which generate significant heat in addition to sound, such as aircraft engines, rocket motors or other loud, heat-generating sources, for example. Also, by forming the beads from a material with a relatively low thermal conductivity, the beads can also be used for thermal insulation in addition to sound absorption.

33 Claims, 10 Drawing Sheets

APPARATUSES AND METHODS FOR SOUND ABSORPTION USING HOLLOW BEADS LOOSELY CONTAINED IN AN ENCLOSURE

1. FIELD OF THE INVENTION

This invention relates to sound absorption using hollow beads loosely contained in an enclosure. By using materials with relatively low thermal conductivity to form the hollow beads, the invention can be used for thermal-insulation, in addition to sound absorption, applications. The beads can also be used to damp sound in high-temperature environments by forming the hollow beads from a material capable of withstanding relatively high temperatures.

2. DESCRIPTION OF THE RELATED ART

Helmholtz resonators are commonly used to damp sound in a variety of applications. In basic configuration, a Helmholtz resonator includes a hollow neck or throat communicating with a resonating cavity. At its fundamental frequency and harmonics thereof, the Helmholtz resonator resonates and thus absorbs the energy of sound waves at these frequencies. The volume V of the resonating cavity, the size A of the cross-section of the hollow throat and the length L of the throat extension can be designed so that the Helmholtz resonator resonates at a resonance frequency approximately given by $$f=\frac{C}{2\pi}\left[\frac{A}{V\cdot L}\right]^{1/2}$$

where C is the speed of sound in the medium in which the Helmholtz resonator is used (typically, the medium is ambient air). For a given volume V, a plurality of throats can also be used to obtain resonance and thus absorption of sound producing this resonance (for details see Ingard, Uno, "On the Theory and Design of Acoustic Resonators," *The Journal of the Acoustical Society of America,* Vol. 25, No. 6, November, 1953). With some resonator geometries, it is possible to maintain the same resonant frequency if the throat area A is split into several smaller equal areas with a total combined area equal to A. This will happen when the shell or wall thickness, t, at the neck is much greater than $0.96\ (A)^{1/2}$. The resonance frequency will also remain constant when $t<<0.96(A)^{1/2}$ for $A_n=A/n^2$, where the original throat area is split into n smaller apertures of area $A_n$ each.

U.S. Pat. No. 4,600,078 (the "'078 patent") issued Jul. 15, 1986 to Leslie S. Wirt, discloses a sound barrier using Helmholtz resonators situated between two walls. In one embodiment, the throats of the Helmholtz resonators are attached to frames situated between spaced, opposing walls, a configuration suggested to be suitable for aircraft windows. In a second embodiment, the '078 patent discloses a netting used to hold Helmholtz resonators between fiberglass blankets inside respective side walls. In a third embodiment, the '078 patent discloses the use of fiberglass blankets supported by respective side walls, which hold the Helmholtz resonators in place by squeezing the resonators from opposing sides. Finally, the '078 patent discloses a fourth embodiment in which the Helmholtz resonators are formed by joining two sheets that together, when assembled, define resonators with throats housed inside of respective spherical bodies. The sheets have fiberglass attached thereto, and the assembled fiberglass blankets and sheets are positioned between two side walls so that spaces exist between the side walls, and opposing fiberglass and sheets. Due to the provision of the spaces, the throats of the resonators are not obstructed by the side walls. The '078 patent states that the second, third and fourth embodiments can be used between the side walls of an aircraft fuselage.

Although the embodiments of the '078 patent are meritorious in many respects for sound absorption applications, they do suffer from some significant drawbacks. The throat and spherical body of the '078 patent have a configuration that is relatively difficult to use and construct. Also, the throat is exposed to damage by extending away from the surface of the spherical body (this is true even of the fourth embodiment of the '078 patent when the sheets are disassembled). Further, the sizes of the Helmholtz resonators disclosed in the '078 patent (a preferred example has a spherical body that measures 3½ inches in diameter) dictates that relatively few resonators can be used in a particular area of a sound barrier wall. Consequently, the tuning of the resonators to their respective resonant frequencies must be relatively precise if sound absorption is required over a range of frequencies, and any damage or defect in a resonator can seriously affect the sound absorption capabilities of the wall. In addition, although some embodiments of the '078 patent provide thermal insulation in addition to sound absorption, an advantageous feature in many applications, the thermal insulation and sound absorption characteristics of the embodiments result from the combination of different materials. The combination of different materials adds cost and leads to complication in construction of a thermally-insulating, sound absorption wall.

Although never associated with sound absorption, spheres made of different ceramic powders including mullite, alumina, zirconia and kaolin, have been glued together with a ceramic glue and used for various structures including low mass kiln furniture, radiant burners, high-temperature, load-bearing insulation and filters for molten metal. Because the spheres are glued together, they are entirely incapable of damping sound through resonance in these various applications. As a previously undesired result of manufacture, some of the hollow spheres used in these structures have been found to have holes therein as a result of certain conditions in their manufacture. Also, although not associated with sound absorption, ceramic spheres with holes have been proposed for investigation for use in growing anaerobic bacteria.

SUMMARY OF THE INVENTION

This invention overcomes the problems described above. An apparatus in accordance with this invention includes a plurality of hollow beads loosely contained in an enclosure. The enclosure allows sound waves to pass to the beads which significantly damp the sound waves. Preferably, the beads vary with respect to the volume of the respective hollow spaces defined by the beads, and the respective thicknesses of the bead walls which define the respective hollow spaces. Also, the beads preferably have respective openings communicating with their respective hollow spaces, which vary in size and/or number. Each bead defines a resonator which resonates at a resonance frequency determined by the volume of the hollow space defined by the bead, the thickness of the wall of the bead and the size and number of the openings of the bead. By using a plurality of beads which vary with respect to hollow space volume, wall thickness, opening size, and/or number of openings on each bead, the beads can collectively damp a broad range of frequencies. The range of sound wave frequencies that can be absorbed with the beads can be extended to lower frequencies by the use of more than one opening on at least some of the beads contained in the enclosure, which convert energy at relatively low frequencies in the sound wave into vorticity. Preferably, the beads are relatively small and so are densely grouped for a given volume, and thus present a tortuous path to sound waves. In other words, the sound waves traveling through the beads are repeatedly reflected from surfaces of the beads so that the sound waves are significantly damped by the air and beads encountered by the sound waves along their tortuous paths of travel. The repeated reflections of the sound waves by the beads also increases the probability that the sound waves will encounter a bead or beads with a frequency of resonance that is a component of a sound wave, thus leading to absorption of the sound wave component. In addition to the significant sound absorption characteristics of the devices of this invention, the beads can be made of a material with a relatively low thermal conductivity so that the beads also can be used for thermal insulation. Further, by forming the beads from a material such as ceramic or a high-temperature metal such as nickel, the beads can withstand relatively high-temperatures and so can be used for applications in which the source of the sound waves generates substantial heat, as occurs in rocket motors, or aircraft or automobile engine exhausts, for example. Relatively low thermal conductivity, high-temperature-withstanding beads can also be used in a wall of a building, house or aircraft structure, for example, as a thermally-insulating fire wall. These beads can also be used as a liner material downstream of a combustion chamber of an aero-engine or as a liner downstream of a turbine of an aero-engine. In addition, the beads can be used as a liner material on the walls of an ejector surrounding a cold or heated jet flow of an aero-engine.

The methods of this invention include steps of loosely containing hollow beads in an enclosure, and damping sound waves with the beads. The beads can be poured, projected or placed into the enclosure, features which make the beads relatively easy to handle.

Advantageously, the beads contained in the enclosure, in accordance with this invention, damp a wide range of frequencies due to variations in hollow space volume, wall thickness, opening sizes and number of openings, which occur inherently in the manufacture of the beads. Thus, this invention requires no detailed, individually specific design or tuning of Helmholtz resonators to achieve damping over a broad range of sound wave frequencies by Helmholtz resonance. Also, due to the relatively small size of the beads, the beads are densely bunched for a given volume relative to prior art Helmholtz resonators, and thus the beads present a tortuous path to sound waves travelling in the beads, causing significant damping of the sound waves. Further, because the beads are relatively small compared to prior art Helmholtz resonators, they can be poured or projected into an enclosure, and so are relatively easy to handle. In addition, the beads can be constructed of a material with a relatively low thermal conductivity, so that the beads provide thermal insulation, a feature that eliminates the relative complication in construction and additional cost required by combining different materials in prior art devices to achieve both sound absorption and thermal insulation. Further, the beads can be made from a material able to withstand relatively high-temperatures, such as ceramic so that the beads can be used with aircraft or automobile engines, or rocket motors which generate significant heat as well as sound. Depending on the application in which the beads are used, the beads can also be made from materials including a metal such as nickel, wood, glass or plastic or other materials.

These together with other objects and advantages, which will become subsequently apparent, reside in the details of construction and operation as more fully hereinafter described and claimed, reference being made to the accompanying drawings, forming a part hereof, wherein like numerals refer to like parts throughout.

BRIEF DESCRIPTION OF THE DRAWINGS

The present invention can be better understood with reference to the following drawings. The drawings are not necessarily to scale, emphasis instead being placed upon clearly illustrating principles of the present invention.

DESCRIPTION OF THE PREFERRED EMBODIMENTS

Figure 1:
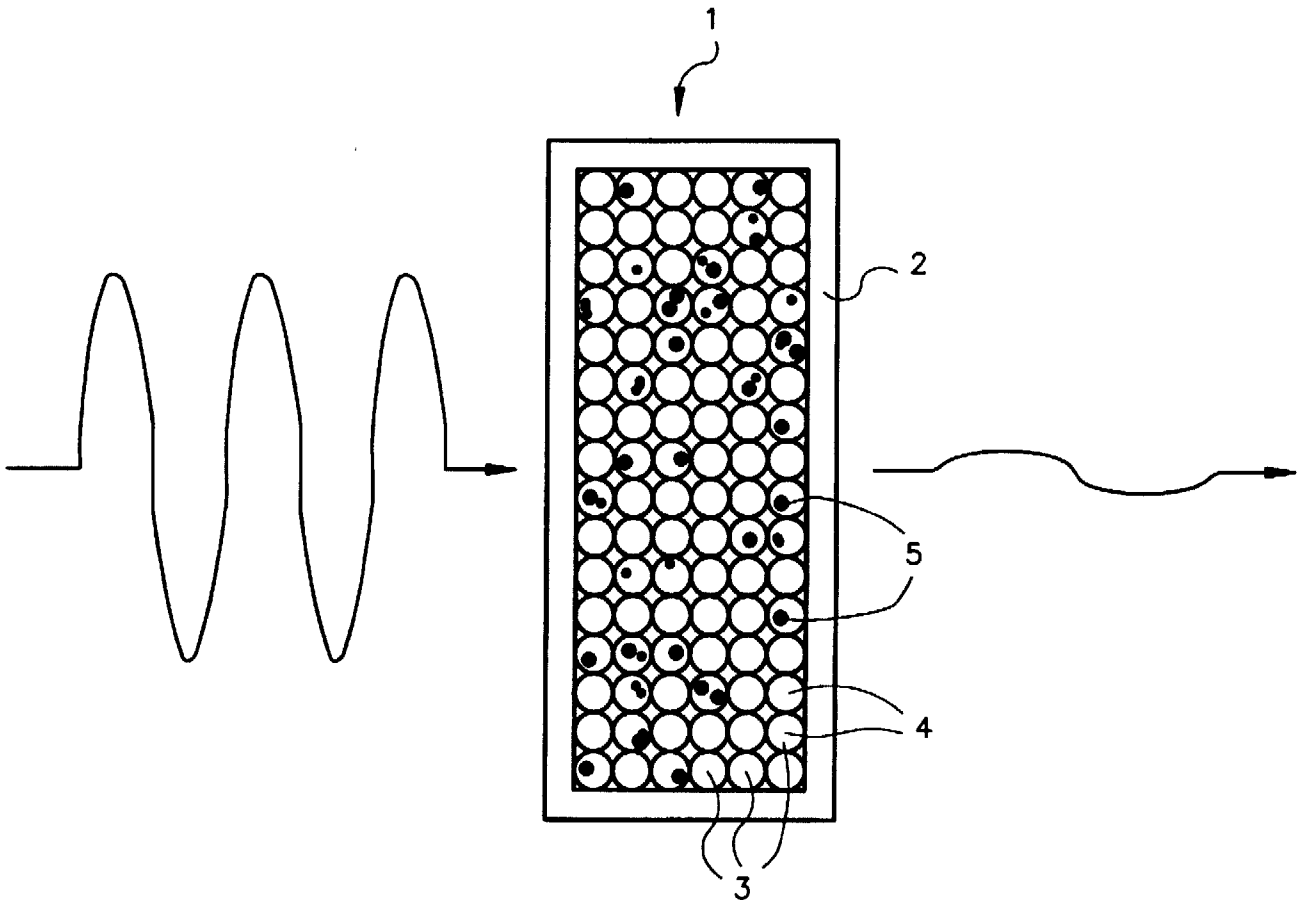
FIG. 1 is a cross-sectional diagram of a sound absorption device including an enclosure loosely containing beads, in accordance with this invention.

In FIG. 1, a sound absorption device 1 includes an enclosure 2 loosely containing beads 3 (only a few of which are specifically indicated in FIG. 1). The beads have walls 4 (only a few of which are specifically indicated in FIG. 1) that define respective hollow spaces. Although the beads 3 of FIG. 1 have spherical or elliptical shapes, other shapes can be used. Also, the beads 3 preferably include respective openings 5 (only a few of which are specifically indicated in FIG. 1) which communicate with the respective hollow spaces of the beads 3. More than one opening 5 can be formed in each bead 3. Each bead 3 generally defines a resonator with a frequency of resonance that depends on its hollow space volume, wall thickness, the number of openings and/or the opening sizes. The characteristic frequency of each bead 3 is approximately determined according to the equation $$f=\frac{C}{2\pi}\left[\frac{A}{V\cdot L}\right]^{1/2},$$

where f is the resonant frequency, C is the speed of sound in a medium in which the bead 3 is situated (e.g., air), A is the area or size of the opening(s) 5, V is the volume of the hollow space defined by the bead 3, and L is the thickness of the wall 4 in proximity to the opening(s) 5. By varying the volume of the hollow space enclosed by each bead 3, the thickness of the respective walls 4 of the beads 3 and/or the size of the openings 5 of the beads 3, the beads 3 collectively absorb energy of sound waves over a broad range of frequencies. Thus, when a sound wave encounters a bead 3 with a resonance frequency that is included in the sound wave, the bead 3 will resonate and absorb a corresponding frequency component and its harmonics from the sound wave. For this reason, it is important that the beads 3 be loosely confined, as opposed to being fixed, in the enclosure 2 to allow the beads 3 to resonate to absorb energy in the sound waves. In FIG. 1, this absorption of energy is represented by a sound wave with a relatively large amplitude that travels from the left to the right side of FIG. 2 through the enclosure 2. The beads 3 in the enclosure 2 absorb the energy of the sound wave, and thus, the sound wave leaves the enclosure 2 from right side in FIG. 1, with an amplitude significantly attenuated relative to its amplitude on the left side of the enclosure 2 in FIG. 1.

If the beads 3 have a plurality of openings 5 formed therein, the beads have additional sound absorbing capabilities. Specifically, sound can enter a bead 3 from one opening and exit from another opening. In this process, part of the sound is converted into vorticity, a phenomenon which can absorb sound at relatively low frequencies at which Helmholtz resonance may be weak. Thus, if relatively low frequencies of sound are desired to be damped for a particular application, at least some of the beads 3 in the enclosure 2 should preferably include plural openings 5.

Also, it should be noted that the beads 3 are capable of absorbing sound even if formed without openings 5. In this case, the varying hollow space volumes and wall thicknesses will absorb sound over a range of frequencies, but not with the consistency over a range of frequencies or the degree of effectiveness for most frequencies that is possible if the openings 5 are formed in the beads 3.

Importantly, the beads 3 damp sound not only through Helmholtz resonance and vorticity, but also by presenting a tortuous path to sound waves. In other words, because the beads 3 are relatively small in size and large in number for a given volume, the outer surfaces of the beads 3 repeatedly reflect the sound waves incident thereto. Also, when a bead 3 resonates, sound is emitted from its opening 5, a phenomenon which also leads to scattering of sound waves due to the random orientation of the openings 5 of respective beads 3. Thus, rather than traveling directly from one to the other side of the enclosure 2, the sound waves generally travel a longer, tortuous path along which the sound waves are attenuated by the medium (e.g., air) and beads 3 in the enclosure 2. Further, the longer path of travel of the sound waves caused by reflection from the bead surfaces and redirection of sound waves from the opening(s) 5 of resonating beads 3, increase the likelihood that the sound waves will encounter beads 3 with resonance frequencies at or near frequencies in the sound waves. Thus, the frequency components of the sound waves are synergistically damped due to the tortuous paths presented by the beads 3 as well as by the resonance and conversion of sound to vorticity provided by the beads 3.

In addition to sound-damping, the beads 3 can be made of a material with a relatively low thermal conductivity so that the beads provide thermal insulation. Suitable low thermal conductivity materials include ceramics, wood, plastic or other materials. Also, the beads 3 can be made of a material which can withstand relatively high temperatures so that the beads are suitable for use in proximity to rocket motors, automobile or aircraft engines, or in walls of building structures to serve as fire walls. The beads 3 can be made of a relatively high-temperature-withstanding material such as a ceramic including mullite, alumina, zirconia and/or kaolin, for example, or from a high-temperature metal such as nickel.

In size, the beads 3 are less than 3½" in largest dimension (which is the preferred dimension of the Helmholtz resonator of the '078 patent) and preferably have a size from 1 to 10 millimeters in largest diameter, a wall thickness of 12 to 200 microns, and an opening(s) 5 ranging from approximately 50–500 microns in diameter. Of course, other dimensions can be used without departing from the scope of this invention. Ceramic varieties of the beads 3 called Aerospheres™ are available with or without openings 5 from Ceramic Fillers™, Inc. of Atlanta, Ga. and similar beads are available from Norton Company™, Inc., Worster, Mass., hollow glass and ceramic beads are available from 3M™ Corporation, Inc., St. Paul, Minn., and hollow glass spheres are manufactured by Missouri-Scientific™ Corporation of Rolla, Mo. and Potters Industries™, Inc. of Valley Forge, Pa. Other possible sources of suitable beads are listed in the Thomas Register under the subject title "Microspheres" (the Thomas Register can be obtained by writing to Thomas Register, 1 Penn Plaza, New York, N.Y. 10119).

The enclosure 2 can be realized with a variety of materials in a variety of ways. Several specific embodiments of the enclosure 2 will be described later in this document.

Figure 2:
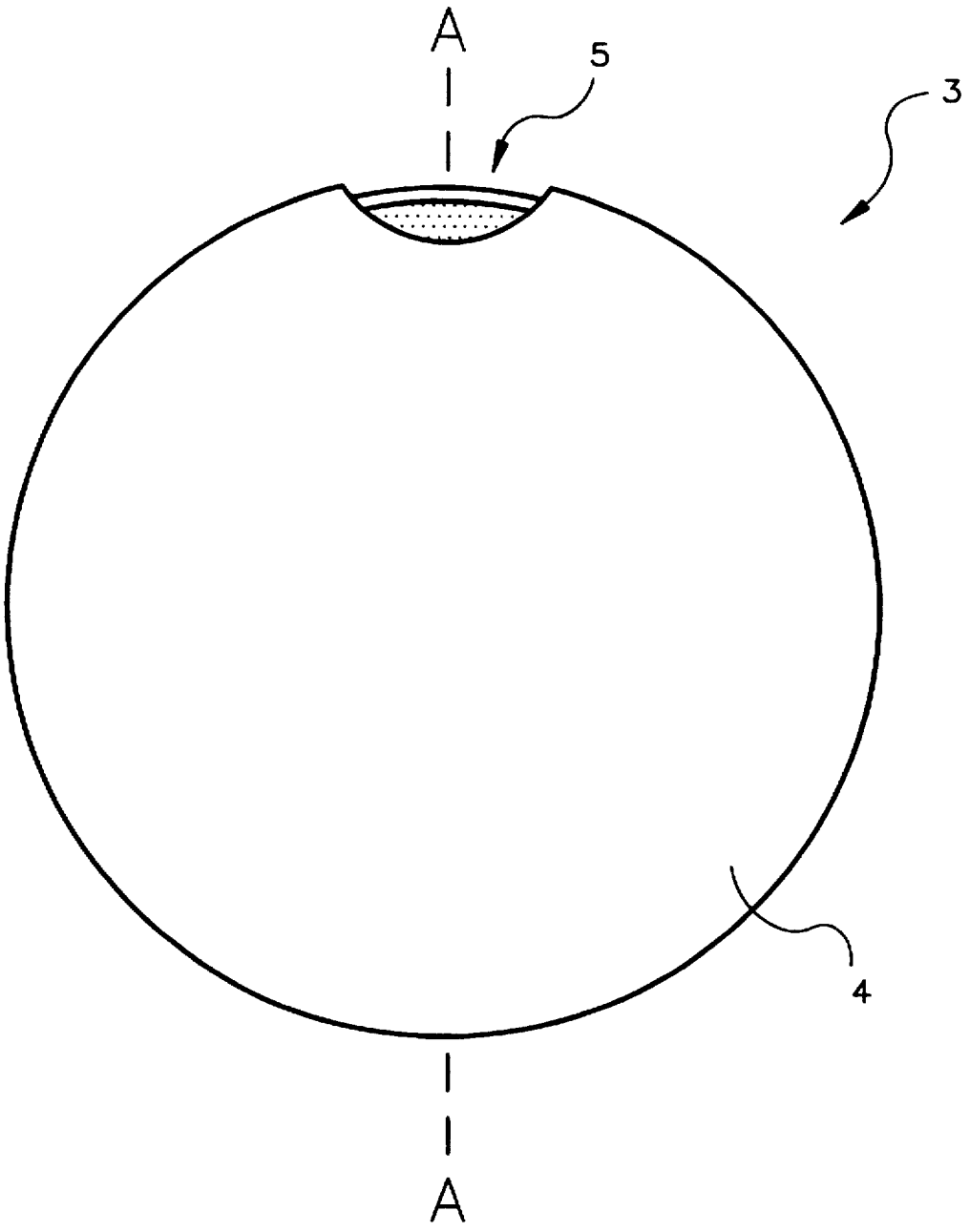
FIG. 2 is a magnified view of a bead in accordance with this invention.

FIG. 2 is a view of a single bead 3. The bead 3, shown in FIG. 2 significantly magnified relative to its preferred range of sizes, has a wall 4 which is spherical or elliptical in shape. Of course, the bead 3 can be formed in other shapes, the main requirement for the bead 3 being that it defines a hollow space. Preferably, the wall 4 defines an opening 5 which communicates with the hollow space defined by the wall 4. Particularly when relatively low frequency components of a sound wave are desired to be absorbed, the beads 3 are preferably formed such that they have a plurality of openings 5 which cause the sound waves to be converted into vorticity inside of and upon exiting the bead 3, thus causing sound absorption of the sound wave's low frequency components. A similar vorticity absorption effect can be obtained using a bead 3 with a porous wall 4 with a plurality of relatively small openings 5. In fact, the beads 3 can have openings 5 that are not visible to the naked eye, yet still effectively absorb sound through vorticity and Helmholtz resonance. Importantly, while the bead 3 of FIG. 2 includes an opening 5, the inventor has found that hollow beads 3 with no openings 5, are also effective to significantly damp sound, although not to the degree of effectiveness that is possible if the beads 3 have the openings 5. Whether the beads 3 are formed with respective openings 5 or not, the configuration of the beads 3 is greatly simplified relative to Helmholtz resonators such as those disclosed in the '078 patent which have throat extensions connected to a hollow body, an awkward configuration due to the extension of the throats from the spherical body. Thus, because the beads 3 include no throat extensions, the beads 3 of this invention are relatively easy to manufacture and handle.

Figure 3:
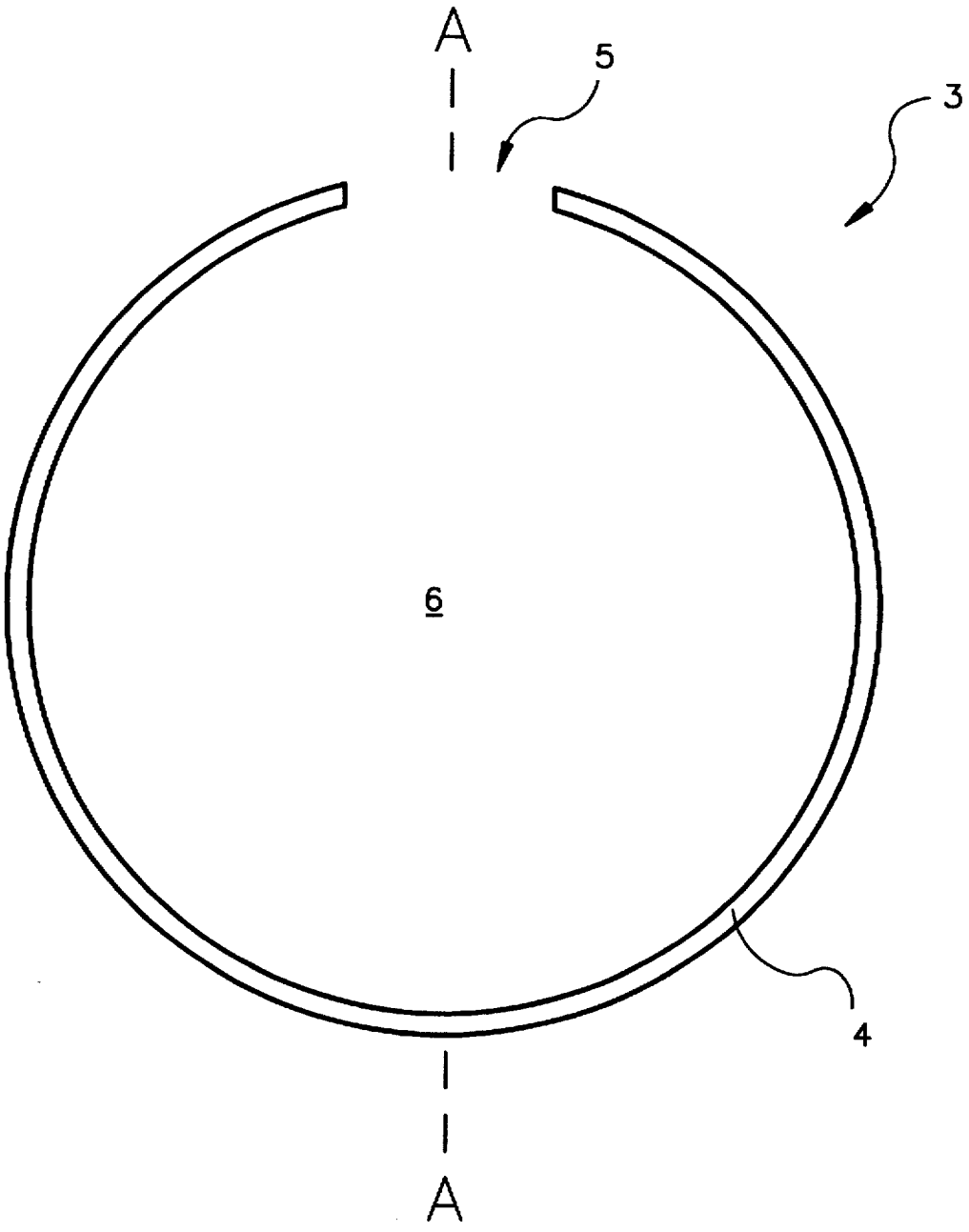
FIG. 3 is a cross-sectional view of the bead of FIG. 2.

FIG. 3 is a cross-sectional view of the bead 3 of FIG. 2 taken along the section A—A in FIG. 2. In FIG. 3, the hollow space 6 defined by the wall 4 of the bead 3 can be clearly seen. Also, as can be seen in FIG. 3, the bead 3 has no throat extension, and thus departs from the standard configuration or geometry of a Helmholtz resonator for this reason. Rather than having a throat extension as used in a standard Helmholtz resonator, the thickness of the wall 4 of the bead 3 in proximity to the opening 5 defines a virtual throat with a relatively small length that is equal to the wall thickness. Thus, the bead 3 of this invention eliminates the need for forming or attaching a throat to a resonating body as required with prior art Helmholtz resonators. The manufacture and handling of the beads 3 of this invention is thus greatly simplified relative to prior art Helmholtz resonators.

Figure 4:
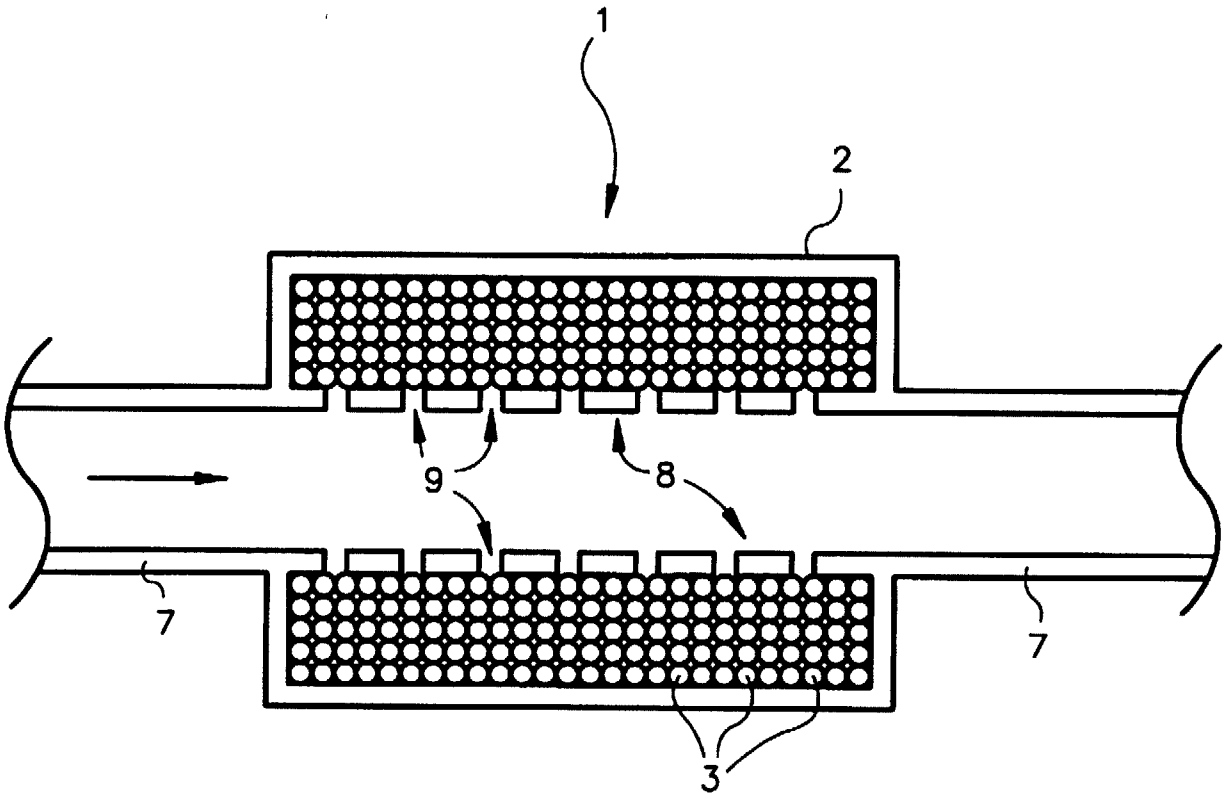
FIG. 4 is a cross-sectional view of a first preferred embodiment of the sound absorption device in accordance with this invention.

FIG. 4 is a first preferred embodiment of the sound absorption device 1 in accordance with this invention. In FIG. 4, the sound absorption device 1 is connected to a conduit or pipe 7 receiving exhaust and sound waves from a combustion engine of an automobile or truck, for example. The sound absorption device 1 of FIG. 4 includes a perforated conduit 8 formed integrally with or attached to the conduit 7. The conduit 8 has perforations 9 defined therein (only a few of which are specifically indicated in FIG. 4), which are small enough to contain the beads 3 loosely in the enclosure 2, but large enough to allow the sound waves to impinge upon the beads 3 in the enclosure 2. The sound absorption device 1 of FIG. 4 is suitable for damping sound waves generated by a combustion engine or the like, and is similar in overall function to a standard automobile muffler. The beads 3 can be made of a high-temperature material to withstand the relatively elevated temperatures of the exhaust and heat generated by the combustion engine. Further, the beads 3 can be formed from a material with relatively low thermal conductivity to insulate heat-sensitive devices or materials proximate to the conduits 7,8 from the heat generated by the combustion engine and/or transferred by the conduits 7, 8.

Figure 5:
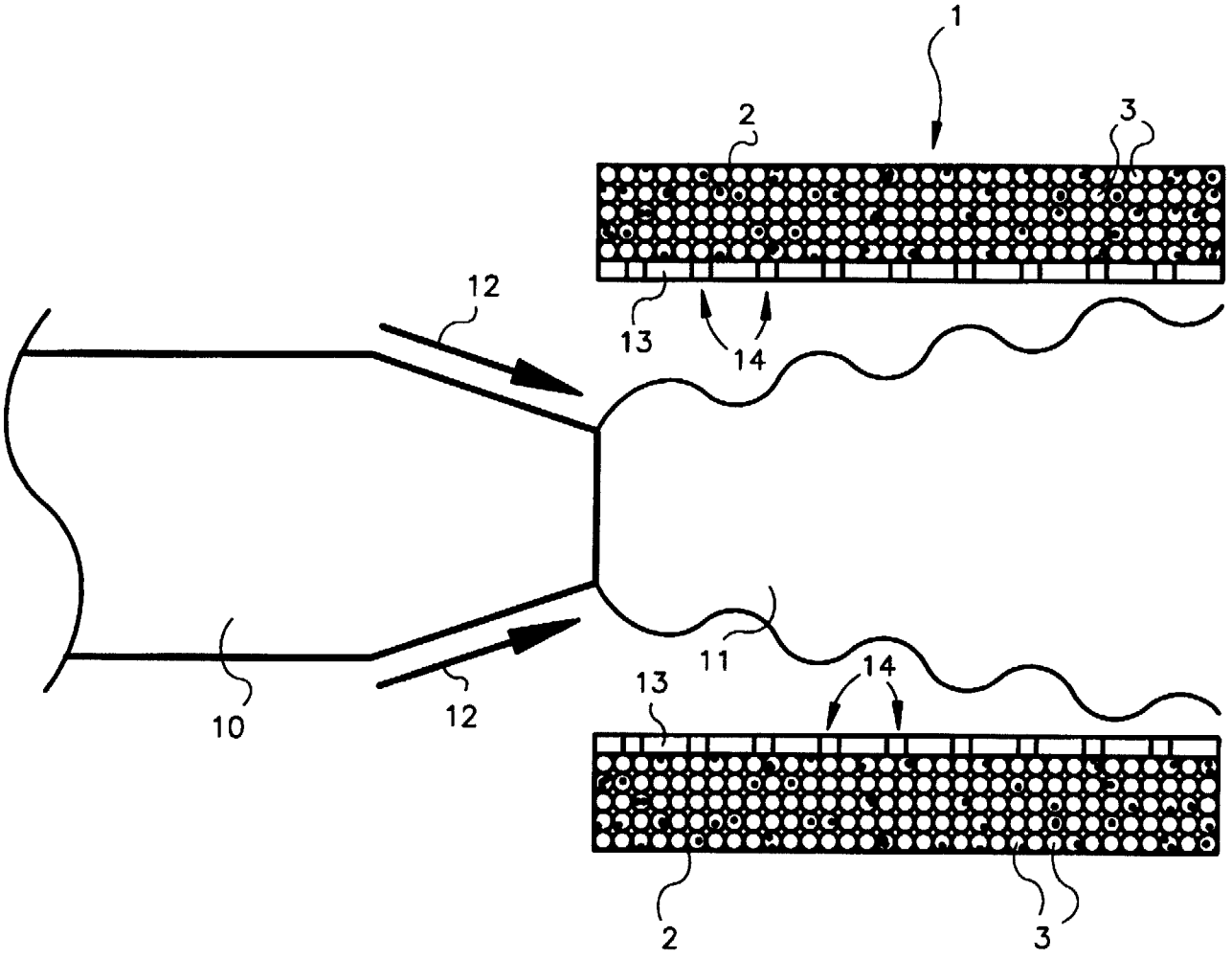
FIG. 5 is a cross-sectional view of a second preferred embodiment of the sound absorption device of this invention.

FIG. 5 is a second preferred embodiment of the sound absorption device 1 of this invention. In FIG. 5, the sound absorption device 1 is realized as a shroud or an ejector of an aircraft engine 10 shown in cross-section in FIG. 5. The engine 10 generates a jet stream 11 of gasses passed through the shroud or sound absorption device 1. The sound absorption device 1 thus encloses the jet stream 11 emitted by the engine 10. In addition to the thrust provided by the jet stream 11 itself, additional thrust is generated by the air 12 which is drawn through the sound absorption device 1 by suction generated by the jet stream 11. Without the use of the sound absorption device 1, the ejector of FIG. 5 would in most cases be extremely loud. However, the sound absorption device 1 of FIG. 5 provides significant sound-damping of the noise generated within the ejector. The sound absorption device 1 of FIG. 5 has a perforated sheet 13 with perforations 14 defined therein (only a few of which are specifically indicated in FIG. 5). The perforations 14 allow sound waves generated by the ejector system of FIG. 5 to impinge upon the beads 3 (only a few of which are specifically indicated in FIG. 5) housed in the enclosure 2. The perforations 14 have dimensions smaller than the minimum size of the beads 3 so that the beads 3 are contained in the enclosure 2. Through tortuous path scattering and resonance by the beads 3, the sound absorption device 1 of FIG. 5 significantly damps the sound waves generated by the engine 10.

In some applications, the weight of the beads 3 may be such that the fuel economy of an aircraft using the sound absorption device 1 of FIG. 5, can be adversely affected unless additional measures are implemented. In such cases, the beads 3 can be manufactured so as to have relatively fragile walls 4 which break or crumble at a relatively slow rate due to the concussion and vibration generated by the engine 10. Thus, on take-off of the aircraft, the beads 3 are relatively intact and absorbing sound when most needed as the aircraft engine 10 is in a relatively loud high-power mode, a feature that is particularly desirable as the aircraft travels at low altitudes over residential areas near an airport. However, due to vibration and/or concussion caused by the engine 10, the beads 3 eventually disintegrate to dust and are expelled from the enclosure 2 through the perforations 14 and out of the end of the shroud. Alternatively, the enclosure 2 can be formed with selectively opening vents or the like which release the beads 3, or the dust thereof, after the aircraft reaches a predetermined altitude, for example. Thus, when there is no longer significant need for the sound-damping of the beads 3 after take-off, the beads 3 can be left intact, but are preferably broken, and discharged from the aircraft by moving the beads or crushed beads toward the vents either with a selectively-activated mechanical actuator or with an air flow selectively supplied to the enclosure, to shed the weight of the beads 3 to achieve fuel-economy. Further, a grinding machine can be installed in the enclosure 2 to grind the beads 3 into dust to be discharged through the perforations 14 or vents or the like using an air flow or mechanical actuator, for example. Still further, the enclosure 2 can have a plate(s) or the like attached to a hydraulic, pneumatic or electromechanical actuator that drives the plate(s) to crush the beads 3 to dust against the sheet 13 or other surface, the dust being discharged through the perforations 14 or vents in the enclosure 2, for example, by moving the dust with an air flow supplied to the enclosure or with a mechanical actuator that urges the dust toward the perforations 14 or vents.

Figure 6:
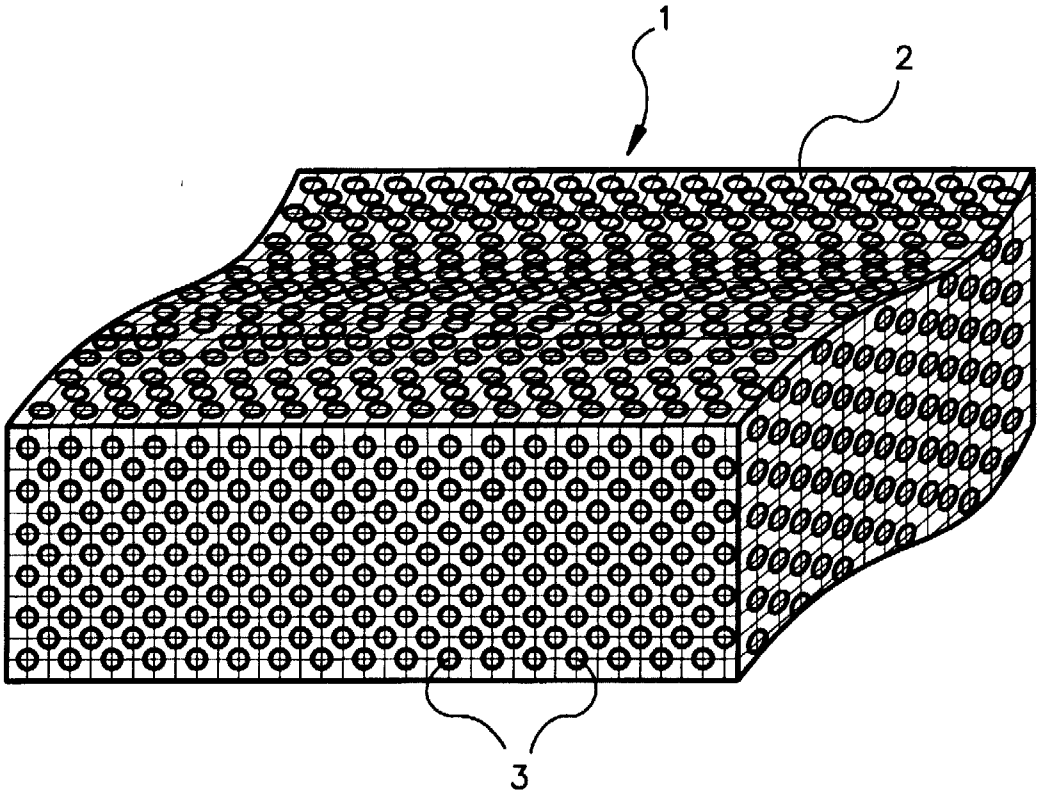
FIG. 6 is a third preferred embodiment of the sound absorption device in accordance with this invention.

FIG. 6 is a third preferred embodiment of a sound absorption device 1 in accordance with this invention. In FIG. 6, the sound absorption device 1 includes an enclosure 2 made of a screen material such as a metal wire screen, which houses beads 3 (only a few of which are specifically indicated in FIG. 6). The sound absorption device 1 of FIG. 6 can be made by welding, sewing, taping or crimping the edges of the screen to form an enclosure 2 with an open side or end. Alternatively, strips of metal or other material can be folded or crimped about loose edges of the screen to hold them together in an enclosure with an open side or end. The beads 3 are then projected, poured or otherwise placed inside of the screen enclosure 2 of FIG. 6 and the open side or end is closed by welding, sewing, taping and/or crimping, etc. the edges of the enclosure 2 together. Of course, the screen forming the enclosure 2 has openings which are sufficiently small to prevent the beads 3 from escaping the enclosure 2, and yet sufficiently large to allow sound waves to travel readily through the screen to the beads 3 housed in the enclosure 2. Advantageously, due to the flexibility of the screen composing the enclosure 2, the sound absorption device 1 of FIG. 6 can be used for a variety of applications as the enclosure 2 will generally conform to the shape of the source of the sound waves to be damped, or other object in proximity to the sound wave source. The enclosure 2 thus need only be suitably attached directly or in proximity to the source generating the sound waves. This attachment can be implemented by welding or adhering the enclosure 2 directly or in proximity to the source of the sound waves. Alternatively, this attachment can be realized by providing a ledge, plate or container on or in proximity to the sound wave source, to hold the enclosure 2 in position thereon, and/or by using a strap or belt or the like to hold the enclosure 2 in proximity to the sound wave source.

Figure 7:
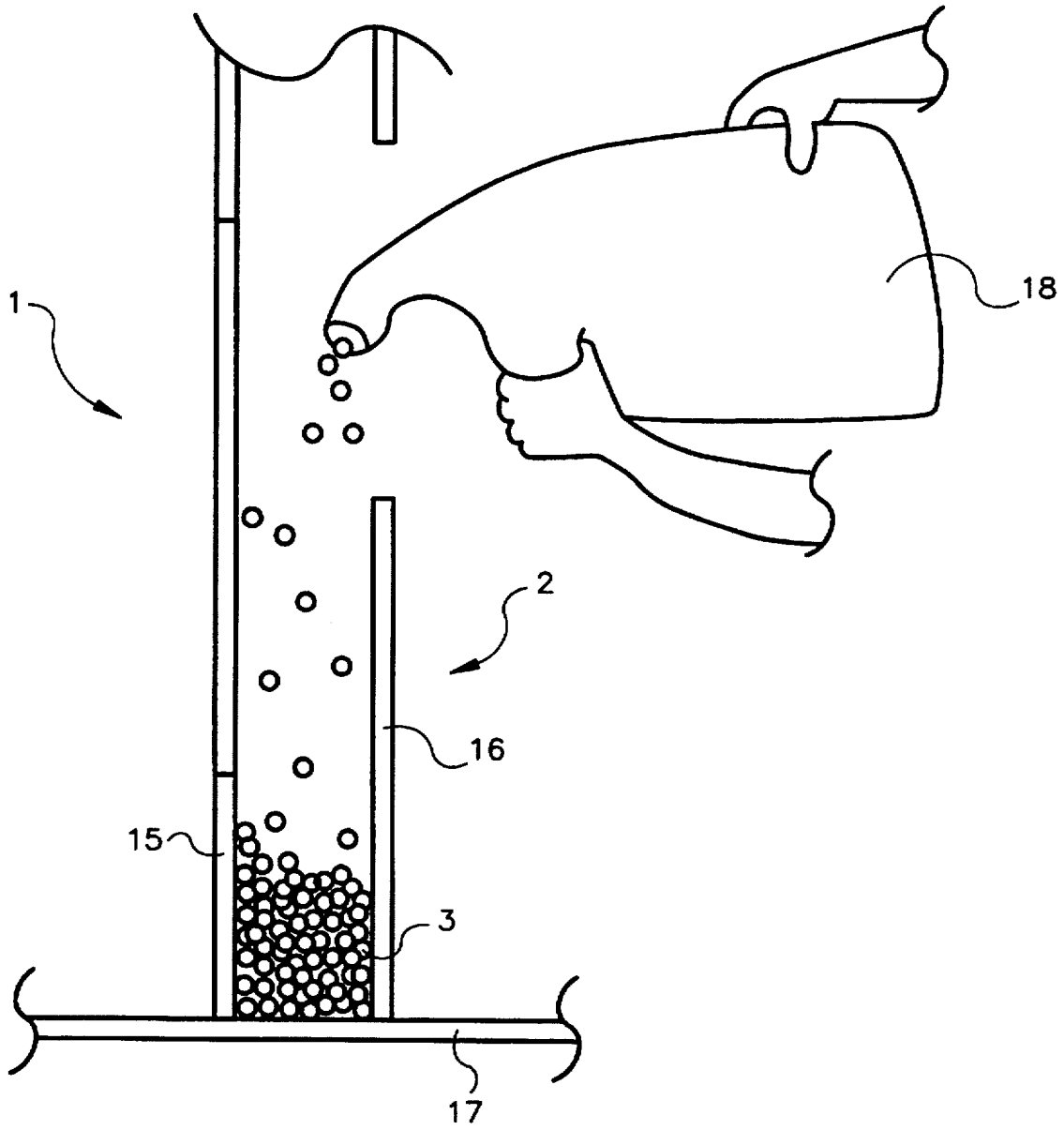
FIG. 7 is a view of a procedure for pouring sound absorption beads inside of an enclosure of a fourth preferred embodiment of this invention, which is a wall in a building, house or aircraft structure, for example.

FIG. 7 is a fourth preferred embodiment of the present invention. In FIG. 7, a sound absorption device 1 includes an enclosure 2 which is a wall of a building, house or aircraft structure. The wall 2 includes two wall sides 15, 16 abutting a floor 17. Through an opening in one of the wall sides 15, 16, beads 3 are poured from a container 18 (in this case a sack or bag used to transport and store the beads) into containment between the wall sides 15, 16. The wall 2 thus defines an enclosure 2 housing the beads 3. Advantageously, the wall 2 of FIG. 7 containing the beads 3 significantly damps sound waves to prevent the sound waves from traveling from room to room in a building or house, or from the outside to the inside of an aircraft structure, for example. Further, if the beads 3 are composed of a relatively low-thermal conductivity material, the beads 3 can provide significant thermal insulation to reduce the energy needed to heat or cool the structure. In addition, if the beads 3 are formed of a material able to withstand relatively high temperatures, such as ceramic or a high-temperature metal such as nickel, and enclosed in an enclosure such as a high-temperature metal screen (see FIG. 6) inside of the wall, the wall 2 is suitable for use as a fire wall to prevent the spread of a fire in the structure. Thus, the sound absorption device 1 of this invention can be used to save property or even lives in the event of a fire in a building, house or aircraft structure, for example.

Figure 8:
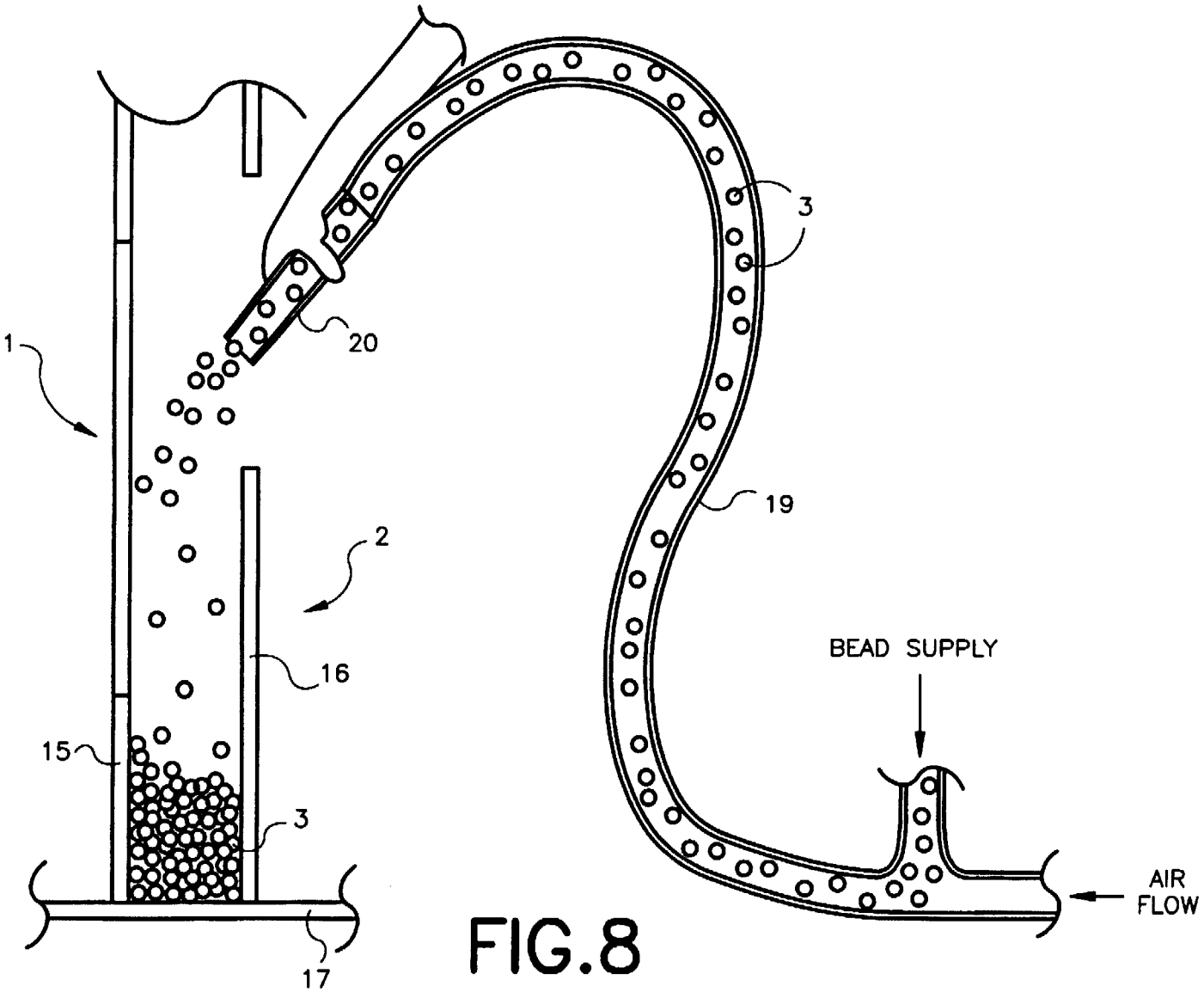
FIG. 8 is a view of a procedure for projecting beads into an enclosure of the fourth embodiment of this invention.

FIG. 8 is a cross-sectional view of the fourth embodiment of this invention, illustrating a different technique than that used in FIG. 7 for filling a wall 2 with beads 3. In FIG. 8, beads 3 from a bead supply are fed into an air flow stream in a hose 19. The beads 3, impelled by the air flow, travel down the hose 19 and through the nozzle 20 held by an operator, that directs the beads 3 between the wall sides 15, 16. The beads 3 are thus projected at a rapid rate between the wall sides 15, 16 for containment in the wall enclosure 2.

A wall 2 containing beads 3 similar to that of FIGS. 7 and 8, can also be used to suppress sound in proximity to a rocket launch site. In this application, the wall 2 is build around the launch site area and the beads 3 are situated inside of the wall 2. Due to sound absorption by the beads 3, the noise generated by a rocket on take-off is significantly reduced in locations outside of the wall 2.

Figure 9:
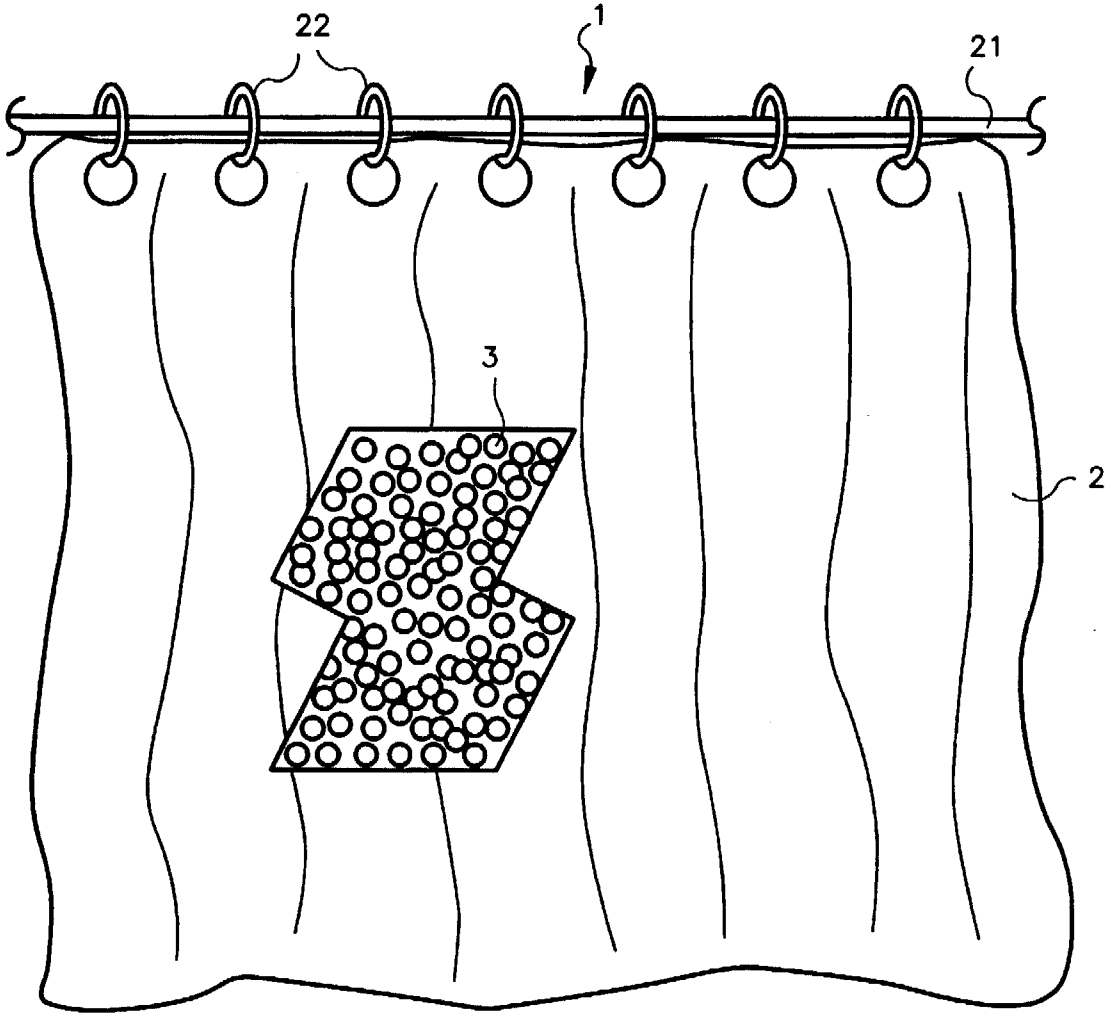
FIG. 9 is a partial cutaway view of a fifth preferred embodiment of the sound absorption device of this invention.

FIG. 9 is a partial cutaway view of a fifth preferred embodiment of the sound absorption device 1 of the present invention. In this embodiment, the enclosure 2 is a curtain including a material sewn together to form a containment area that holds the beads 3 which are shown in the cutaway area of the curtain in FIG. 9. The curtain 2 is hung from a curtain rod 21 or other support with rings 22 (only a few of which are specifically indicated in FIG. 9), for example. The curtain 2 can be realized by sewing together two sheets of material to define a containment area, or can be formed from sheets that are quilted to form pockets containing the beads 3. The fifth embodiment of the sound absorption device 1 of this invention can be used in factories to damp sound generated in noisy operations on a work floor, or can be used in a home to damp street noise, for example.

The enclosure 2 containing the beads 3 can also be a blanket or sheet wrapped loosely about or body-fitted around noisy machinery, for example. The blanket enclosure 2 can be similar to the curtain 2 of FIG. 9 made with a material sheet sewn together or otherwise constructed to define a containment area for the beads 3. Further, the blanket 2 can be quilted to form pockets in the blanket to limit the movement of the beads 3 in the blanket. The sheet enclosure 2 can be formed of a material sheet that is fitted about a machine, for example, to hold the beads 3 in proximity to a machine to suppress the noise thereof.

Figure 10:
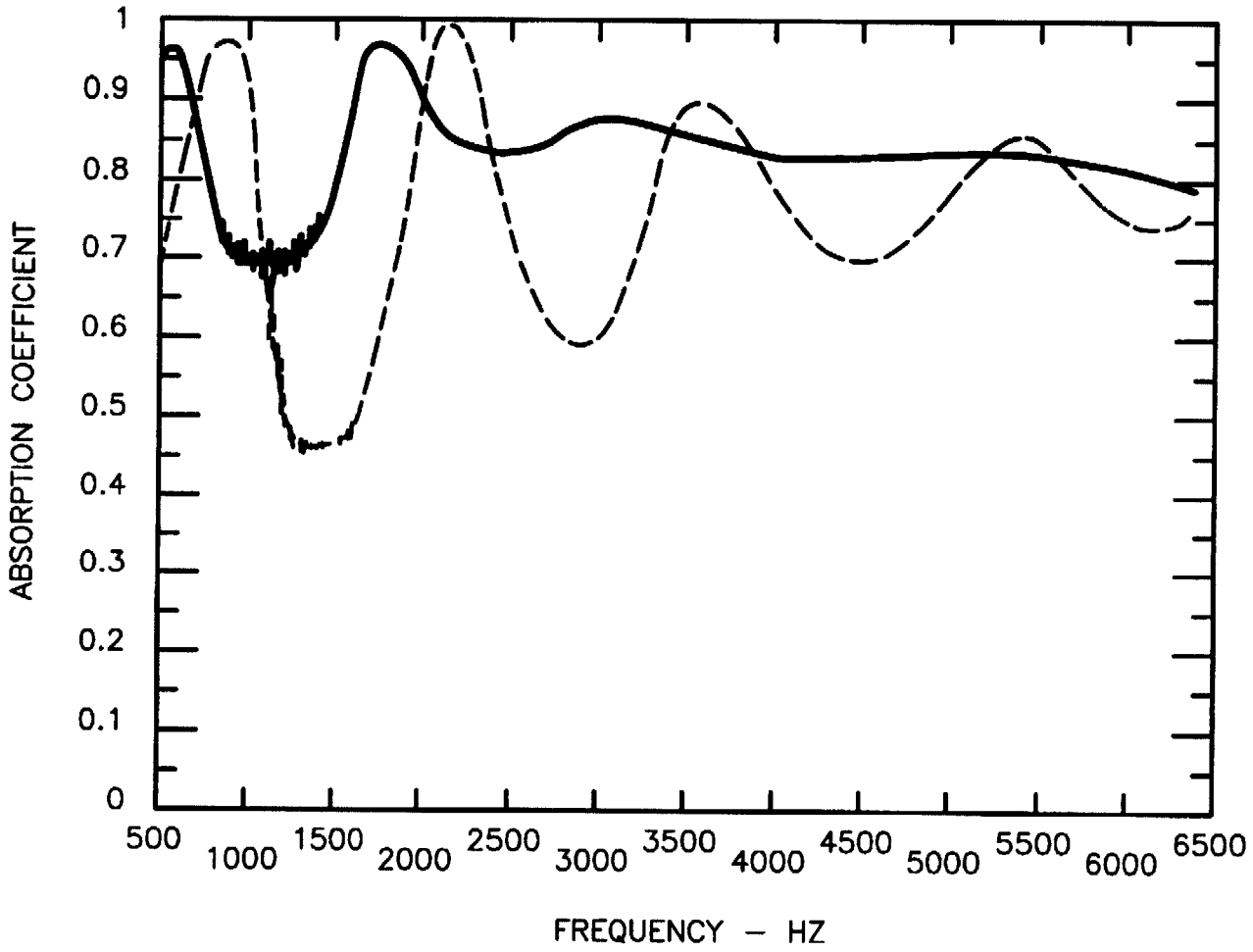
FIG. 10 is a graph of absorption coefficient versus frequency for two sound absorption devices in accordance with this invention.

FIG. 10 is a graph illustrating the sound absorption capabilities of two different devices 1 of the type illustrated in the third preferred embodiment of this invention in FIG. 6. The graphs in FIG. 10 were prepared using sound absorption devices 1 with alumina ceramic spheres approximately 0.14" in diameter, with opening diameters ranging about 100 microns, and with a thickness of the enclosure 2 of 3.44". The broken line in FIG. 10 indicates the absorption coefficient (i.e., the amplitude of the sound passing through the device 1 divided by the amplitude of the sound incident to the device) as a function of frequency for beads 3 without openings formed therein. Although the beads 3 without openings 5 perform significant sound absorption, the absorption coefficient for the beads 3 without openings is highly dependent upon the frequency of the sound waves. For example, at about 1400 Hz, the absorption coefficient is about 0.45 whereas at about 2100 Hz, the absorption coefficient is about 0.98. The solid line shows the sound absorption performance of the device 1 using beads 3 with openings 5. In this case, the sound damping is much more uniform than in the case of the beads 3 without openings 5, and provides significant damping (over 80%) for most frequencies of interest.

Although the invention has been described with specific illustrations and embodiments, it will be clear to those of ordinary skill in the art that various modifications may be made therein without departing from the spirit and scope of the invention as outlined in the following claims.

I claim:

1. A device for receiving sound waves, the device comprising:

a plurality of beads, wherein each said bead includes an outer wall defining a hollow space within the bead, and an opening in the outer wall, allowing the hollow space to acoustically communicate with space outside the bead;

an enclosure loosely containing the beads and including an interior space which acoustically communicates with the bead hollow spaces through the bead outer wall openings, the enclosure further including at least one inlet for allowing the interior space to acoustically communicate with a sound wave generating source which is exterior to said enclosure;

wherein the enclosure allows the sound waves to travel through at least one inlet within the enclosure, through the bead outer wall openings, and into the hollow spaces within beads for damping sound waves which enter the enclosure; and wherein the hollow spaces among the plurality of beads differ in volume within a specified range to correspond to a predetermined frequency range of maximum sound absorption.

2. A device as claimed in claim 1, wherein the enclosure is a blanket.

3. A device as claimed in claim 2, wherein the blanket is quilted.

4. A device as claimed in claim 1, wherein the respective openings are different sizes.

5. A device as claimed in claim 3, wherein at least one bead has more than one opening.

6. A device as claimed in claim 1, wherein the beads have respective walls with different thicknesses.

7. A device as claimed in claim 1, wherein the beads are composed of a material with a relatively low thermal conductivity.

8. A device as claimed in claim 7, wherein the beads are composed of material able to withstand relatively high temperatures.

9. A device as claimed in claim 8, wherein the material is ceramic.

10. A device as claimed in claim 8, wherein the material is metal.

11. A device as claimed in claim 10, wherein the metal is nickel.

12. A device as claimed in claim 8, wherein the beads define respective hollow spaces with different volumes.

13. A device as claimed in claim 8, wherein the beads have respective openings defined therein, the openings communicating with respective hollow spaces.

14. A device as claimed in claim 13, wherein the openings are different sizes.

15. A device as claimed in claim 8, wherein the beads have respective walls with different thicknesses.

16. A device as claimed in claim 1, wherein the beads are less than 3½ inches in largest dimension.

17. A device as claimed in claim 1, wherein the beads are poured into the enclosure.

18. A device as claimed in claim 1, wherein the beads are projected into the enclosure.

19. A device as claimed in claim 1, wherein the enclosure includes a screen defining openings sufficiently small to prevent the beads from escaping the enclosure, but sufficiently large to allow sound to pass therethrough.

20. A device as claimed in claim 1, wherein the enclosure substantially surrounds an exhaust flow from a combustion engine.

21. A device as claimed in claim 1, wherein the enclosure substantially forms a lining of an ejector of an aircraft engine.

22. A device as claimed in claim 1, wherein the enclosure substantially surrounds an exhaust port of a rocket motor.

23. A device as claimed in claim 1, wherein the enclosure is located in proximity to a rocket launch site to suppress noise generated by a rocket on lift off.

24. A device as claimed in claim 1, wherein the enclosure is a wall of a structure.

25. A device as claimed in claim 1, wherein the enclosure is a curtain.

26. A method comprising the steps of:

loosely containing beads in an enclosure having an interior space, wherein each bead includes an outer wall defining a hollow space therein, and at least one opening in the outer wall for acoustically communicating the hollow space in each said bead with the interior space;

varying volumes of the hollow spaces of the beads within a specified range to correspond to a predetermined frequency range of maximum sound absorption;

receiving sound waves into the enclosure;

receiving sound waves travelling within the enclosure into said beads through the bead outer wall openings and into the bead hollow spaces; and (b) damping a predetermined frequency range of sound waves with the beads which corresponds to the specified volume range of the bead hollow spaces.

27. A method as claimed in claim 26, further comprising the step of:

projecting the beads into the enclosure.

28. A method as claimed in claim 26, further comprising the step of:

placing the enclosure in proximity to a source generating the sound waves.

29. A method as claimed in claim 26, further comprising the step of:

breaking the beads; and discharging the broken beads from the enclosure.

30. A method as claimed in claim 26, further comprising the step of:

discharging the beads from the enclosure.

31. A method as claimed in claim 26, wherein at least one bead has more than one opening.

32. A method as claimed in claim 26, wherein the beads have respective walls with different thicknesses.

33. A method as claimed in claim 26, further comprising the step of:

pouring the beads into the enclosure.

* * * * *